United States Patent [19]

Hall

[11] 4,127,228

[45] Nov. 28, 1978

[54] ASPARAGUS BOX

[75] Inventor: Richard A. Hall, Danville, Calif.

[73] Assignee: Willamette Industries, Inc., San Leandro, Calif.

[21] Appl. No.: 821,647

[22] Filed: Aug. 4, 1977

[51] Int. Cl.[2] ..... B65D 5/00; B65D 5/22

[52] U.S. Cl. ..... 229/16 R; 229/35; 229/16 D; 229/32

[58] Field of Search ..... 229/16 R, 16 A, 16 C, 229/32, 6 A, 33, 35, 22

[56] References Cited

U.S. PATENT DOCUMENTS

| | | | |
|---|---|---|---|
| 2,106,816 | 2/1938 | Shimizu et al. | 229/32 |
| 2,110,681 | 3/1938 | Rutledge | 229/16 R |
| 2,295,515 | 9/1942 | Hoag | 229/32 |
| 2,298,146 | 10/1942 | Mersbach | 229/32 |
| 2,707,586 | 5/1955 | Buttery | 229/16 R |
| 2,835,432 | 5/1958 | Wilmot | 229/6 A X |
| 2,950,850 | 8/1960 | Corcoran | 229/16 C |
| 3,863,829 | 2/1975 | Merrell | 229/33 X |
| 3,899,121 | 8/1975 | Herbetko | 229/6 A X |

*Primary Examiner*—Davis T. Moorhead
*Attorney, Agent, or Firm*—Robert H. Eckhoff

[57] ABSTRACT

A corrugated box container is provided which is particularly suited to the long distance shipping of fresh asparagus.

1 Claim, 5 Drawing Figures

ASPARAGUS BOX

BACKGROUND OF THE INVENTION

There are few areas in the United States particularly suited to the growing of asparagus. The market for fresh asparagus, however, is widespread. For example, asparagus grown in California is rushed to the New York market either by express train movement or by air. During transit the asparagus continues to grow and if moved by train, in the time interval of 6 to 8 days while it is in transit, the asparagus will grow from an inch to an inch and a half in length. Part of the attraction of the fresh asparagus is the green tip which must not be damaged, else the marketability of the asparagus is reduced substantially.

Prior patents typical of earlier efforts in containers are U.S. Pat. Nos. 2,505,442; 2,596,261; 2,839,236; 2,955,734; 2,827,222; 3,428,234; 3,863,829; 3,910,483; 3,913,824; 3,973,356 and 3,986,657.

SUMMARY OF THE INVENTION

It is in general the broad object of the present invention to provide a novel form of box construction providing a receptacle particularly suited to the packaging of fresh asparagus for market.

Another object of the present invention is to provide an asparagus package which is particularly suited to its marketability, enabling a prospective buyer to view the asparagus without disrupting the package.

The invention includes other objects and features of advantage, some of which, together with the foregoing, will appear hereinafter when a present preferred embodiment of the asparagus box is disclosed.

BRIEF DESCRIPTION OF THE PREFERRED EMBODIMENT

Figure 4:
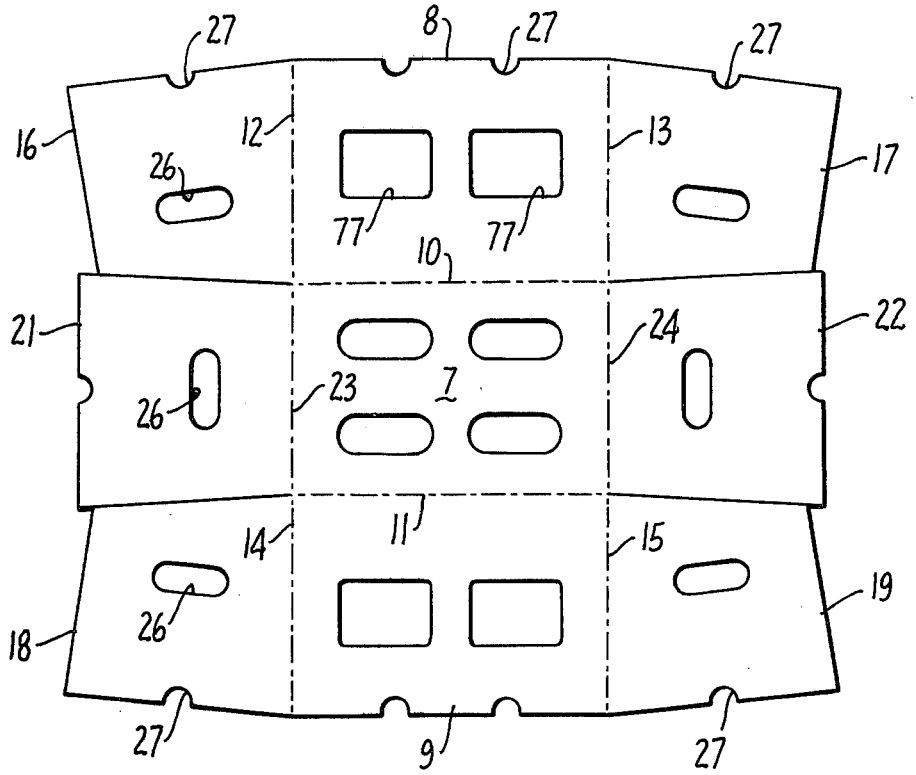
FIGS. 4 and 5 are, respectively, plan views of the upper box element in FIG. 4 and a plan view of the lower box element in FIG. 5.

Referring to the drawings, and particularly FIG. 4, the upper box element is made of a sheet of double face corrugated board having a top section 7 with sides 8 and 9 hinged along scorelines 10 and 11 on opposite sides of the top 7. The sides 8 and 9 form the cover front and rear walls of the set up cover. Hinged to sides 8 and 9 along scorelines 12 and 13 and 14 and 15 are opposite ends or end elements 16 and 17 and 18 and 19. Also hinged on the opposite ends of the top 7 along scorelines 23 and 24 are end members 21 and 22.

The upper box portion is assembled by moving ends 16 and 18 and 17 and 19 into overlapping position after which ends 21 and 22 are moved into overlapping position over the overlapped ends 16 and 18 and 17 and 19. The overlapped elements are then secured together as with an adhesive tape, by stapling or with the use of a suitable adhesive. When so assembled, the ends 16, 18 and 21 and ends 17, 19 and 22 provide a threeply structure at each end of the top 7. The three ply structure forms triple thickness end walls for the set up cover. Thus, I provide relatively strong and rigid ends at each end of the top 7 so that when the assembled box is packed, it can be stacked with several of the boxes stacked one above the other without the boxes collapsing.

Matching handholds 26 are provided in each of the ends 16, 21 and 18 and ends 17, 22 and 19 so that the box can be readily handled and moved from place-to-place. In addition, vent apertures 27 are provided in each of ends 16, 18, 17 and 19 and in the sides 8 and 9.

Figure 5:
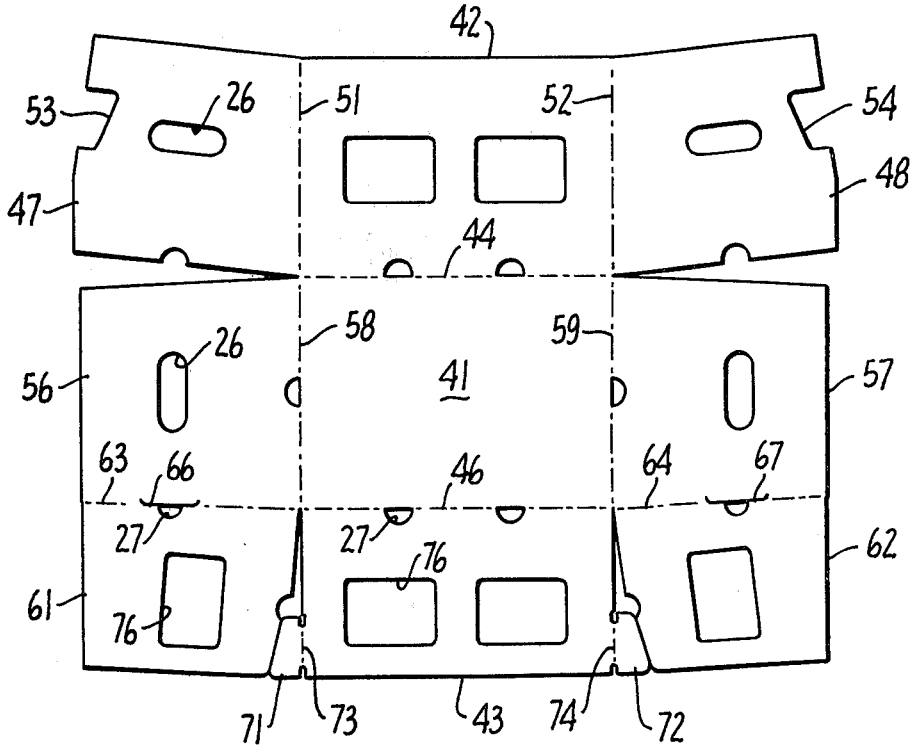

Referring now to FIG. 5, the lower box element includes a bottom 41 having opposite sides 42 and 43 hinged thereon along scorelines 44 and 46. Ends 47 and 48 are provided upon opposite ends of side 42 and are hinged upon scorelines 51 and 52. Each of these includes a cutout portion 53 and 54 for a purpose presently described. Hinged on opposite ends of the bottom 41 are end elements 56 and 57, these being hinged along scorelines 58 and 59. Mounted upon the ends 56 and 57 are side closures 61 and 62, these being hinged along scorelines 63 and 64. Each of the ends 56 and 57 are also scored as at 66 and 67 for a purpose presently described.

To assemble the lower box element, the side 42 is moved into a position in which it extends at an angle to the bottom 41 and the side flaps 47 and 48 are moved on scorelines 51 and 52 so that these extend over the bottom. The ends 56 and 57 are then moved into an overlapping position against ends 47 and 48. In this position the scored portions 66 and 67 will be aligned opposite the notches 53 and 54. Then the side 43 is moved into a position in which it extends at an angle to the bottom 41. After this has been done, the side closures 61 and 62 are moved along scorelines 63 and 64 so that these extend along the bottom 41. The element 43 is then moved into a position in which it overlaps the elements 61 and 62 and tongues 71 and 72 are then each moved along scorelines 73 and 74 and inserted through the apertures provided by the scorelines 66 and 67, the tongues 71 and 72 fitting into the notches 53 and 54. The overlapped elements 47 and 56 and the overlapped elements 48 and 57 can then be secured as by an adhesive tape, a suitable adhesive or by stapling. This overlapping and securing provides a double strength at each end of the box which, together with the triple ends provided by the cover, provide an adequate column support enabling boxes to be stacked one upon the other.

Suitable vent holes 27 matching those in the top portion are provided to permit air and moisture to circulate through the assembled container. The lower bottom element also includes suitable handholds 26 which match those in the upper box element.

To permit viewing of the contents, viewing apertures 77 are provided in sides 8 and 9 in the cover. These apertures match apertures 76 in sides 42 and 43 and in side closures 61 and 62 in the bottom element.

Figure 1:
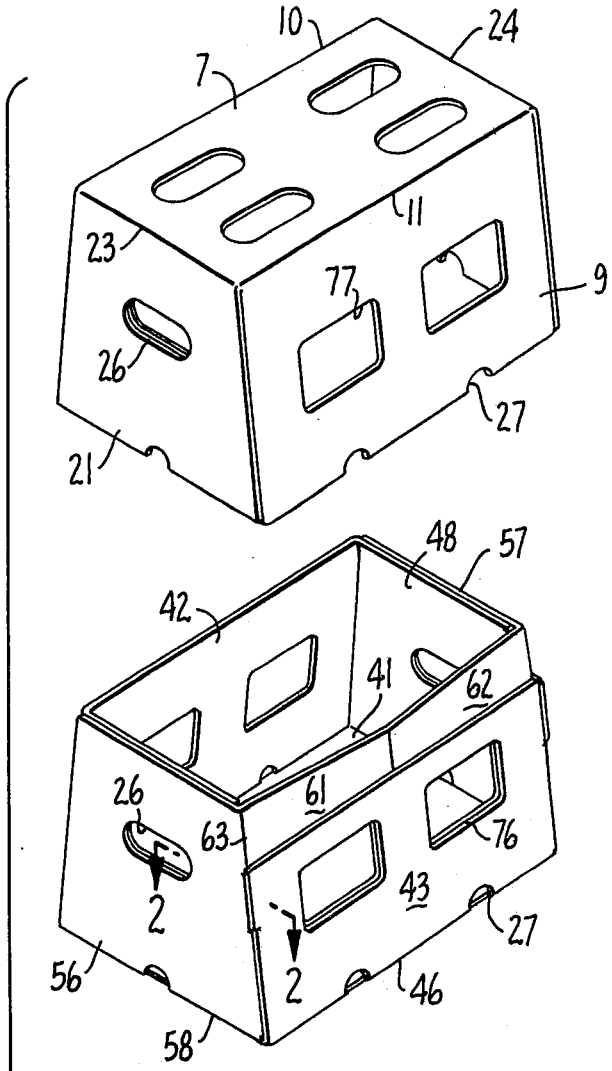
FIG. 1 is an exploded view showing in the lower half of the figure the lower box element having a bottom on which opposite end walls and opposite side walls are hinged for movement relative to the bottom to provide a box having an open top. The lower box element is in the shape of a truncated isosceles trapezoid with parallel end walls. In the upper portion of the figure, an upper box element is shown which is adapted to fit snugly over the lower box element.
Figure 2:
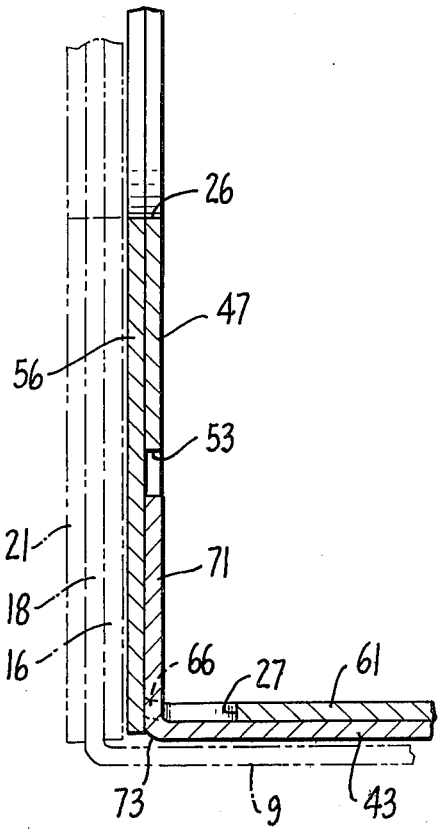
FIG. 2 is a section taken along the line 2—2 in FIG. 1.
Figure 3:
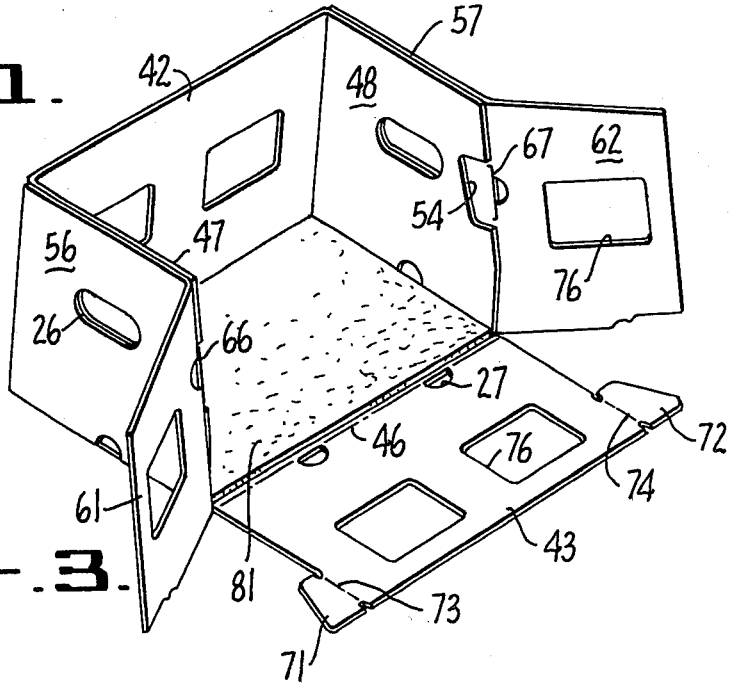
FIG. 3 is a perspective view of the lower box element in position for packing of the asparagus. In this view a lower packing element is shown; this is of an absorbent nature to hold moisture adjacent to the butt of each asparagus spear.

With the lower box element partially assembled as in FIG. 3, an absorbent lower packing element 81 is inserted to retain and supply moisture to the asparagus stalks. The several stalks are then positioned with their spears uppermost and their butt ends on the water - wet lower packing element. The inside height of the box is such that the spears are well below the top box element so they can grow in transit.

From the foregoing, I believe it will be apparent that I have provided a simple and improved box construction, one particularly suited to the packaging and transportation of asparagus from the field to the marketplace.

I claim:

1. A combined shipping and display container of trapezoidal shape for fresh products such as asparagus, the combination comprising a box body having a bottom, a rear wall hinged on said bottom and double thickness side walls, one thickness of said side walls including ends each having the rear edge thereof integral and hingably connected with a respective side of said rear wall, said side wall one thicknesses each having a cutout defined in the edge thereof which is remote from said one edge thereof, the other thickness of each of said side walls including an element having the bottom edge thereof integral with an end of said bottom, side closures hinged on each side wall and movable to provide a front wall parallel to said rear wall, said side closures being foldably attached at one edge thereof by a foldline to said side wall other thickness to open outwardly of the container for providing unobstructed passage of products into the container, said side closures further including viewing apertures defined therein, said foldlines each having a tongue-receiving slot defined therein, a front wall hinged on said bottom and movable into a position in which it overlays said side closures when said side closures are parallel to the rear wall, said front wall having a closure tongue hingedly attached to a pair of opposite edges, said tongues each having notches defined in the top and bottom edges thereof, said tongues, said tongue-receiving slots and said cutouts being located so that said tongues fit through said tongue-receiving slots and are received in said cutouts with said notches engaging the edges of said tongue receiving slots to attach said front wall to said side walls to thereby close the container, said front wall and said rear wall having body vent holes defined therein at the edges thereof connected to said bottom, the rear wall, the side walls and the front wall when so positioned providing an open top box body, and a separate movable cover having a cover top, a cover front wall and a cover rear wall and a pair of triple thickness cover end walls, said cover front and rear walls each having a first member hinged on the cover top and a pair of end elements each hinged on opposite edges of said first members, said last mentioned cover front wall and said cover rear wall each being attached at one edge thereof to opposite edges of said cover top, a pair of end members each attached at one edge thereof to an edge of said cover top, each of the end elements on said cover front being in overlapping relationship with corresponding ones of the end elements on said cover rear wall and with one of said end members to define said triple thickness end walls, said cover front and rear walls having cover vent holes defined therein in the edges thereof which are remote from said one edges, said separable movable cover when assembled fitting snugly about the box body with said body and cover vent holes aligned to provide a ventilatable closure for the open top of the box body.

* * * * *